US009149823B2

(12) United States Patent
Decottignies et al.

(10) Patent No.: US 9,149,823 B2
(45) Date of Patent: Oct. 6, 2015

(54) FLUID PRODUCT DISPENSER

(75) Inventors: Laurent Decottignies, Cergy (FR); Antoine Lamuré, Bosguerard de Marcouville (FR)

(73) Assignee: APTAR FRANCE SAS, Le Neubourg (FR)

( * ) Notice: Subject to any disclaimer, the term of this patent is extended or adjusted under 35 U.S.C. 154(b) by 26 days.

(21) Appl. No.: 13/816,993

(22) PCT Filed: Aug. 23, 2011

(86) PCT No.: PCT/FR2011/051949

§ 371 (c)(1),
(2), (4) Date: Apr. 4, 2013

(87) PCT Pub. No.: WO2012/025692

PCT Pub. Date: Mar. 1, 2012

(65) Prior Publication Data

US 2013/0193166 A1 Aug. 1, 2013

(30) Foreign Application Priority Data

Aug. 26, 2010 (FR) ..... 10 56775

(51) Int. Cl.

| | |
|---|---|
| ***B67D 7/76*** | (2010.01) |
| ***B05B 11/00*** | (2006.01) |
| ***B65D 47/20*** | (2006.01) |
| ***B65D 83/00*** | (2006.01) |

(52) U.S. Cl.

CPC ..... *B05B 11/0021* (2013.01); *B05B 11/0024* (2013.01); *B05B 11/0048* (2013.01); *B65D 47/2081* (2013.01); *B65D 83/0033* (2013.01); *B05B 11/007* (2013.01); *B05B 11/3032* (2013.01); *B05B 11/3047* (2013.01)

(58) Field of Classification Search

CPC ..... B05D 11/0021; B65D 83/0033; A61J 2001/145; A61J 2001/1456

USPC ..... 222/386, 189.09, 189.06, 326, 256, 222/380, 387, 340, 209, 213, 215; 141/2

See application file for complete search history.

(56) References Cited

U.S. PATENT DOCUMENTS

| | | | | |
|---|---|---|---|---|
| 5,829,645 | A * | 11/1998 | Hennemann | 222/189.09 |
| 6,324,966 | B1 * | 12/2001 | Joergensen | 99/297 |
| 7,475,797 | B2 * | 1/2009 | Kim | 222/389 |
| 2005/0139091 | A1 * | 6/2005 | Haverstock | 99/495 |

(Continued)

FOREIGN PATENT DOCUMENTS

| | | | |
|---|---|---|---|
| EP | 2 251 093 | A1 | 11/2010 |
| WO | 2009/109370 | A1 | 9/2009 |

OTHER PUBLICATIONS

International Search Report for PCT/FR2011/051949 dated Nov. 3, 2011.

*Primary Examiner* — Paul R Durand
*Assistant Examiner* — Jeremy W Carroll
(74) *Attorney, Agent, or Firm* — Sughrue Mion, PLLC

(57) ABSTRACT

A fluid dispenser comprising a fluid reservoir (1) and a dispenser member (2), the reservoir (1) comprising a slide cylinder (11) that is cylindrical, and a follower-piston (14) that includes at least one lip (16) that is in sliding contact with the cylinder (11), the slide cylinder (11) being provided with a bottom (12), an equalizing space (E) being formed between the follower-piston (14) and the bottom (12), this space (E) communicating with the outside so as to keep the space (E) at atmospheric pressure, such that, each time fluid is dispensed, outside air penetrates into the space (E), which increases as the follower-piston (14) moves away from the bottom (12); the dispenser being characterized in that a bacterial filter (F1) filters outside air coming into contact with the lip (16) of the follower-piston (11) through the equalizing space (E).

6 Claims, 3 Drawing Sheets

(56) References Cited

U.S. PATENT DOCUMENTS

2006/0255071 A1* 11/2006 Behar et al. ..... 222/256
2007/0068593 A1* 3/2007 Behar et al. ..... 141/2
2007/0102455 A1* 5/2007 Stark et al. ..... 222/207
2007/0151987 A1* 7/2007 Arghyris et al. ..... 222/386.5
2011/0056993 A1* 3/2011 Lee et al. ..... 222/256
2011/0168644 A1* 7/2011 Harris et al. ..... 210/767

* cited by examiner

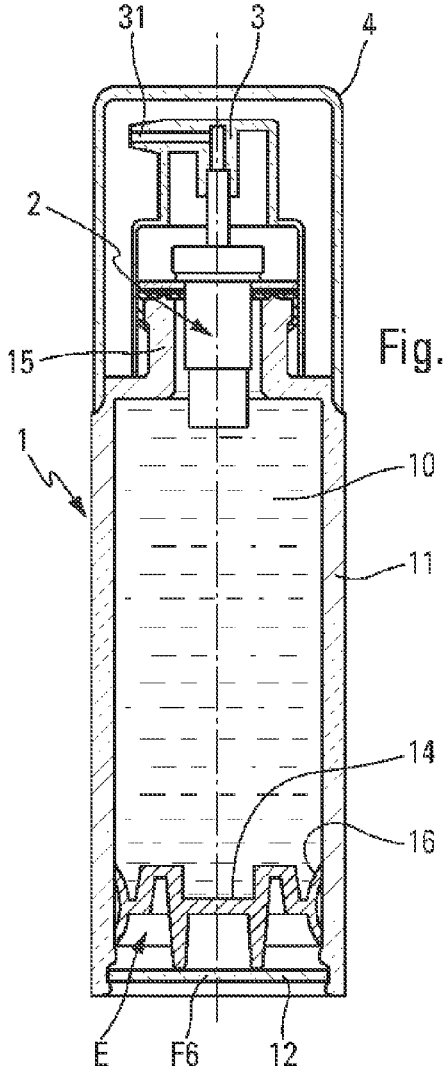
Fig. 7
Fig. 8
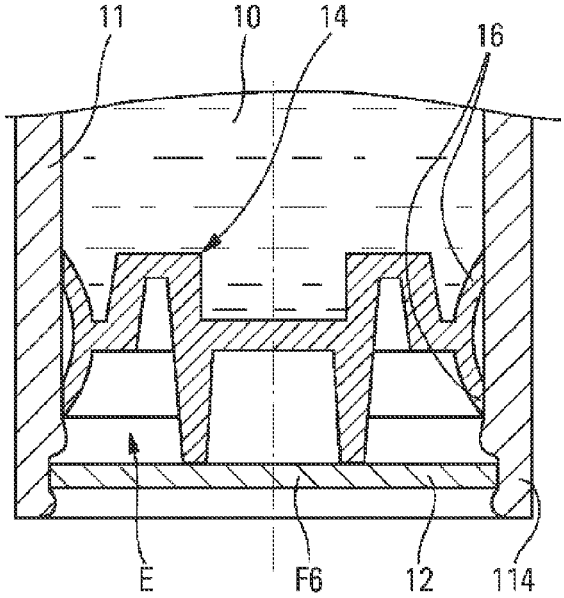
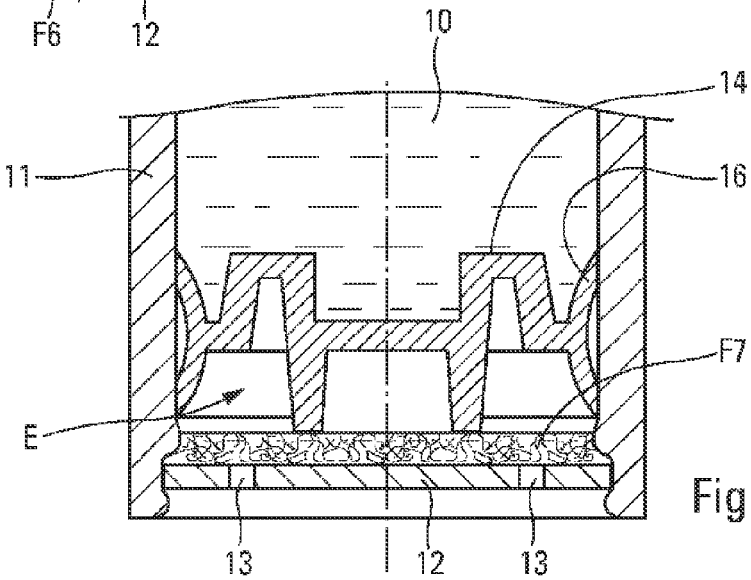
Fig. 9

FLUID PRODUCT DISPENSER

CROSS REFERENCE TO RELATED APPLICATIONS

This application is a National Stage of International Application No. PCT/FR2011/051949 filed Aug. 23, 2011, claiming priority based on French Patent Application No. 1056775 filed Aug. 26, 2010, the contents of all of which are incorporated herein by reference in their entirety.

The present invention relates to a fluid dispenser comprising a fluid reservoir, and a dispenser member, such as a pump or a valve, that is mounted on the reservoir for taking fluid therefrom. The reservoir comprises a slide cylinder and a follower-piston that is movable by sliding inside the cylinder, the cylinder and the piston thereby co-operating with each other to constitute a working volume for storing the fluid. The working volume decreases as the follower-piston moves inside the cylinder. In general, the follower-piston includes at least one lip, otherwise two, in substantially leaktight sliding contact with the cylinder. In addition, the cylinder is provided with a bottom that is arranged remote from the dispenser member. An equalizing space is thus formed between the follower-piston and the bottom, this space communicating with the outside so as to keep the space E at atmospheric pressure, such that, each time fluid is dispensed, outside air penetrates into the space, which increases as the follower-piston moves away from the bottom. This design is entirely conventional in the field of cosmetics. However, this type of dispenser may also be used in other fields, such as the fields of pharmacy and of perfumery, for example.

This type of reservoir, having a slide cylinder and a follower-piston, is generally associated with a dispenser member of the airless type, i.e. without any air inlet, such that the fluid stored inside the reservoir never comes into contact with the outside air via the dispenser member.

In theory, the follower-piston slides inside the slide cylinder in completely leaktight manner, such that outside air cannot penetrate into the reservoir between the slide cylinder and the follower-piston. However, in practice, it turns out that the sliding contact between the follower-piston and the cylinder is not completely or sufficiently leaktight, and this may be for many reasons. For example, the surface quality of the slide cylinder is not always good, and presents a certain amount of irregularity, roughness, or unevenness over which the follower-piston passes, locally without leaktight contact. In other situations, the lip of the follower-piston does not make it possible to provide effective sealing with the slide cylinder. In still other situations, the movement of the follower-piston inside the cylinder is not completely axial, such that the lip lifts off from the slide cylinder at certain points. All of those situations lead to outside air penetrating into the reservoir between the follower-piston and the slide cylinder. Naturally, the quantities of air that penetrate into the reservoir are very small, but they are sometimes enough to spoil, modify, or deteriorate the fluid.

In the prior art, documents WO 2009/109370 and EP 2 251 093 describe fluid dispensers including a reservoir that defines a cylindrical slide cylinder inside which a follower piston is slidably engaged. At its bottom end, the slide cylinder is closed by a separate bottom that defines a through hole that is closed by a bacterial filter. As the follower piston moves, the space between the filter and the follower piston increases and bacteria may develop despite the remote filter.

An object of the invention is to remedy the drawback of the prior art that is associated with a failure of the dynamic sealing between the follower-piston and the slide cylinder.

To do this, the present invention makes provision for the bacterial filter to be secured to the follower-piston. The bacterial filter, that may also be referred to as bactericidal, bacteriostatic, or antibacterial, has the function of allowing outside air to penetrate into the equalizing space while eliminating bacteria or preventing them from penetrating into the equalizing space with the air. The bacterial filter blocks and/or kills bacteria and any other organism that is capable of deteriorating the fluid contained in the reservoir. The bacterial filter may fill, at least in part, the equalizing space as defined at the start of the stroke of the follower-piston.

The spirit of the invention is to create a barrier against bacteria that are carried by outside coming into contact with the lip of the follower-piston. This antibacterial barrier is placed inside the equalizing space that is formed between the follower-piston and the bottom, in contact with the follower piston.

In an embodiment, the follower-piston includes a top sealing lip that is in sliding contact with the cylinder and a bottom lip that is provided with grooves such that the space extends to between the two lips of the follower-piston, and the annular space situated between the slide cylinder and the lips of the follower-piston is filled, at least in part, with a bacterial filter.

The invention is described more fully below with reference to the accompanying drawings, which show several embodiments of the invention by way of non-limiting example.

IN THE FIGURES

FIG. 7 is a vertical section view through another fluid dispenser incorporating a sixth embodiment of the invention;

FIG. 8 is a larger-scale view of the bottom portion of the FIG. 7 dispenser; and FIG. 9 is a view similar to FIG. 8 showing a seventh embodiment of the invention.

Figure 1:
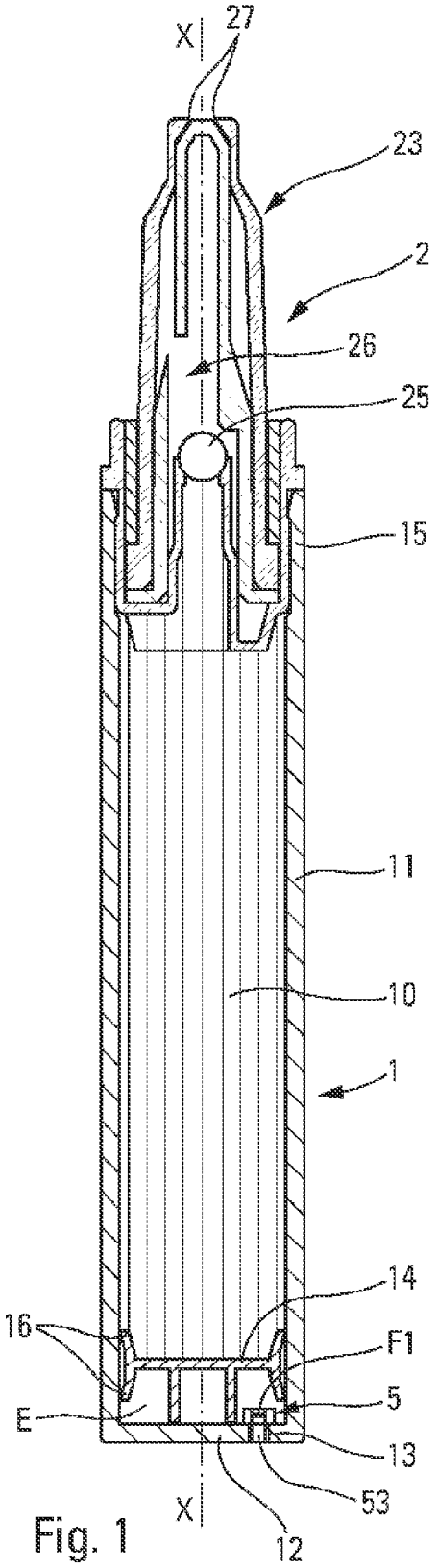
FIG. 1 is a vertical section view through a fluid dispenser in a first embodiment of the invention.

Reference is made firstly to FIG. 1 in order to describe in detail the structure of a fluid dispenser that is suitable for incorporating a bacterial filter in accordance with the invention. The dispenser comprises a fluid reservoir 1 on which there is mounted a dispenser member 2. The fluid reservoir 1 defines a working volume 10 that is filled with fluid, e.g. a cream. The dispenser member 2 is in communication with the fluid of the working volume 10 via an inlet that is provided with an inlet valve 25. When the valve 25 is open, the working volume 10 communicates with a pump chamber 26 that is provided with a deformable actuator wall 23. By pressing on the actuator wall 23, the volume of the chamber 26 decreases, thereby causing the inlet valve 25 to close and an outlet valve to open in such a manner as to define an outlet passage for the fluid through a dispenser orifice 27. The dispenser member 2 is a particular type of pump that is not critical to the present invention. It is possible to fit any type of dispenser member, such as a pump, a valve, or another type of dispenser endpiece, on the reservoir without going beyond the ambit of the invention, given that the dispenser member is not at the core of the invention. However, it is preferable for the dispenser member to be of the airless type, i.e. without any air inlet, so as to avoid any outside air being introduced into the reservoir through the dispenser member.

The fluid reservoir 1 comprises a slide cylinder 11 that presents a shape that is generally cylindrical, e.g. circularly cylindrical. At its top end, the cylinder 11 defines a neck 15 for receiving the dispenser member 2 in stationary and leaktight manner. The cylinder 11 contains a follower-piston 14 that is for sliding in substantially leaktight manner inside the cylinder 11. In this embodiment, the follower-piston 14 includes two dynamic sealing lips 16 that come into sliding contact with the inside of the cylinder 11. When the dispenser member 2 is actuated by squeezing the actuator wall 23, the follower-piston 14 remains in place in the cylinder 11. In contrast, when the pressure on the actuator wall 23 is relaxed, suction is created inside the chamber 26, thereby causing the inlet valve 25 to open and suction to be communicated to the inside of the working volume 10. In response, the follower-piston 14 moves by suction, causing its two annular lips 16 to slide along the cylinder 11. In this way, the working volume 10 of the reservoir decreases progressively as the fluid is extracted therefrom by the dispenser member 2. This technique is entirely conventional for making a reservoir of variable working volume for associating with an airless dispenser member. The follower-piston 14 constitutes a movable wall of the reservoir that moves when subjected to suction. The follower-piston 14 may present any shape as long as it performs its function. The FIG. 1 follower-piston 14 includes two sealing lips 16: however, it is possible to imagine a follower-piston that includes a single sealing lip only.

The slide cylinder 11 is also provided with a bottom 12 that is arranged remotely from the neck 15 that receives the dispenser member 2. In this embodiment, the bottom 12 is made integrally with the cylinder 11, but it is also possible to envisage using a bottom 12 that is fitted on the cylinder 11. The bottom 12 thus closes the cylinder 11 and co-operates with the follower-piston 14 to define an equalizing space E. More precisely, in this embodiment, the equalizing space E is defined by the bottom 12, a small portion of the slide cylinder 11, and the follower-piston 14. In order to enable the follower-piston 14 to move in the cylinder 11 when subjected to suction, it is necessary for the equalizing space E to be subjected to atmospheric pressure at all times. To do this, it is necessary to put the equalizing space E into communication with the outside, e.g. via a hole 13 formed in the bottom 12.

In the invention, the hole 13 in the bottom 12 is provided with a filter assembly 5 that includes a support collar 51 associated with a fastener bushing 52. The collar 51 and the bushing 52 are hollow so as to define a through passage 53. The support collar 51 is used for mounting a bacterial filter F1 that allows air to pass, but that eliminates and/or kills bacteria. By way of example, the bacterial filter F1 may be constituted by a bacteriostatic filter membrane that is permeable to air. As can be seen more clearly in FIG. 2, the filter assembly 5 is mounted on the bottom 12, with the support collar 51 arranged inside the space E, and the fastener bushing 52 inserted in the hole 13 formed in the bottom 12. Thus, outside air may penetrate into the equalizing space E through the through passage 53 and its bacterial filter F1. The air penetrating into the space E is thus filtered, i.e. freed of bacteria that might be in suspension in the air. An equalizing space E is thus obtained that is filled with air that is free from bacteria. In this way, the air contained in the space E does not in any way risk contaminating, deteriorating, or spoiling the fluid contained in the working volume 10 in the event of a leak between the slide cylinder 11 and the lips 16 of the follower-piston 14.

Figure 2:
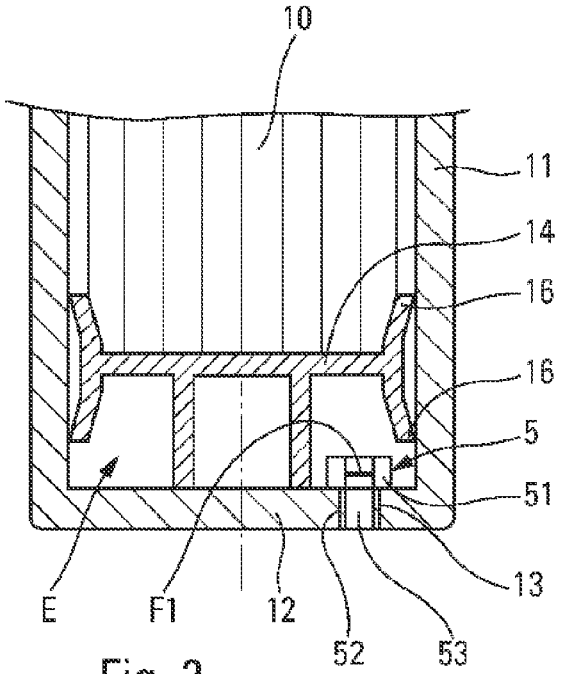
FIG. 2 is a larger-scale view of the bottom portion of the FIG. 1 dispenser.

In the embodiment in FIGS. 1 and 2, the bacterial filter F1 is incorporated in a filter assembly 5 that may be put into place easily, merely by inserting into the hole 13 in the bottom 12. The bacterial filter F1 is thus arranged inside the space E between the bottom and the follower-piston.

Figure 3:
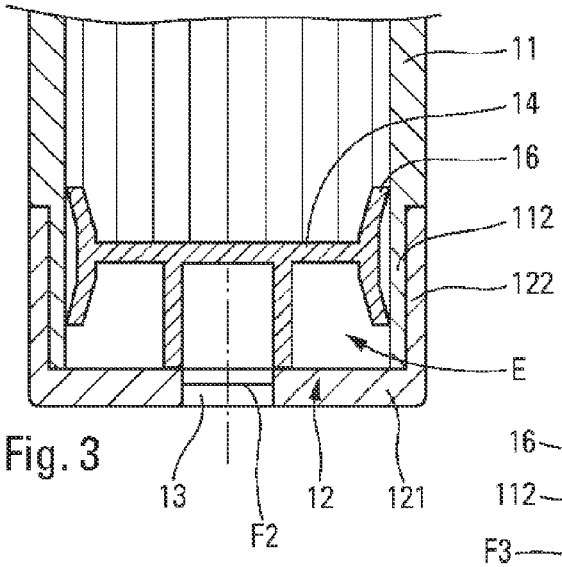
FIGS. 3 and 4 are views similar to FIG. 2 showing second and third embodiments respectively.

FIG. 3 shows a second embodiment in which a bacterial filter F2 is arranged and mounted directly in a hole 13 that is formed in the bottom 12. The bacterial filter F2 may be of the same type as the bacterial filter F1, i.e. a membrane that is permeable to air and that possesses bactericidal qualities. It should be observed that the bottom 12 in FIG. 3 is a fitted bottom, unlike the bottom 12 in FIGS. 1 and 2. To do this, the bottom 12 comprises a bottom wall 121 and a fastener ring 122 that is engaged around a skirt 112 that is formed at the bottom end of the slide cylinder 11. Naturally, it is necessary for the contact between the ring 122 and the skirt 112 to be leaktight, so as to prevent any introduction of bacteria-carrying outside air. In this way, the only air that can penetrate into the space E is the air that passes through the bacterial filter F2 situated in the hole 13. The bacterial filter F2 may be adhesively-bonded, heat-sealed, or molded on the bottom 12. The same applies for the bacterial filter F1.

Figure 4:
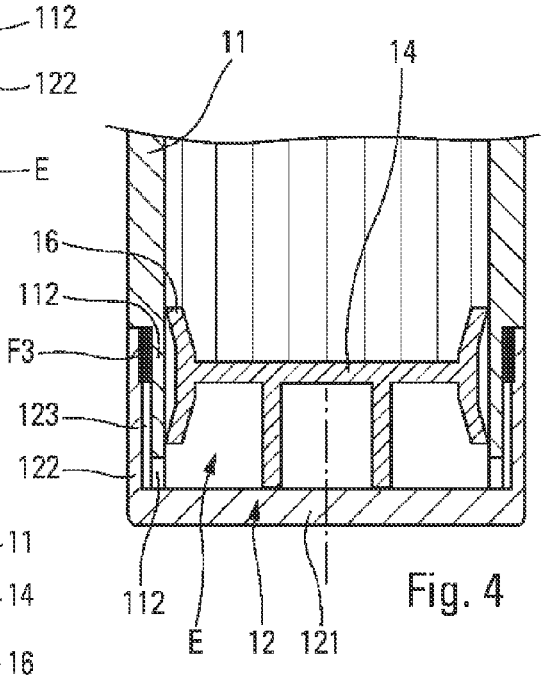

FIG. 4 shows a third embodiment in which the bottom 12 is also a fitted bottom, substantially similar to the bottom in FIG. 3. However, the bottom wall 121 of the bottom 12 does not include any holes. However, the equalizing space E communicates with the outside through an air passage that is formed between the ring 122 and the skirt 112. By way of example, it is possible to provide crenellation 113 at the bottom edge of the skirt 112, and internal splines 123 at the ring. Thus, Air may communicate with the outside through the crenellation 113 and between the splines 123. In the invention, a bacterial filter F3 of annular shape is arranged in the air passage between the skirt 112 and the ring 122. All of the air that penetrates into the space E is thus obliged to pass through the bacterial filter F3. By way of example, the filter may be molded on the cylinder 11 or on the bottom 12. Assembling the bottom 12 on the cylinder 11 does not create any complication. The air in contact with the lips 16 is thus guaranteed to be free of bacteria.

Figure 5:
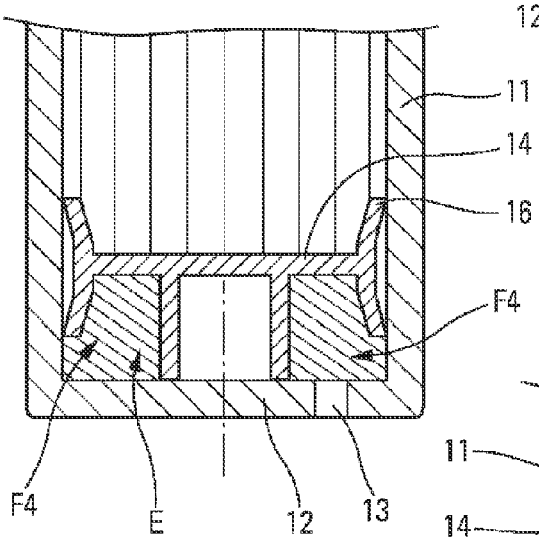
FIGS. 5 and 6 are views similar to FIG. 2 showing fourth and fifth embodiments respectively.

FIG. 5 shows a fourth embodiment in which the bottom 12 is made integrally with the cylinder 11 and includes a through hole 13. In this embodiment, some or all of the equalizing space E is filled with a bacteriostatic material that is porous and permeable to air. By way of example, the material may be injected into the space E through the hole 13. In a variant, it may be arranged at the bottom of the cylinder 11 before the follower-piston is engaged therein. The bacterial filter F4 may be secured to the bottom 12, or, in contrast, to the follower-piston 14. Either way, the air arriving at the lips 16 is guaranteed to be free of bacteria.

Figure 6:
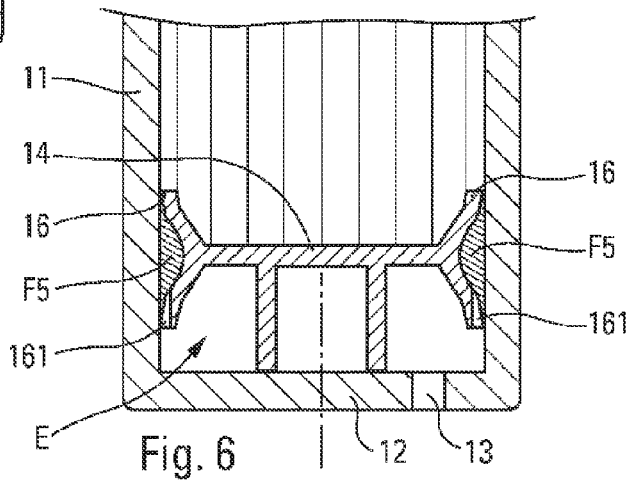

FIG. 6 shows a fifth embodiment in which the follower-piston 14 includes only one sealing lip 16 at the top that is in sliding contact with the cylinder 11. Its bottom lip is provided with grooves 161, such that the space E extends to between the two lips of the follower-piston 14. In the invention, some or all of the annular space situated between the slide cylinder 11 and the lips of the follower-piston is filled with a bacterial filter F5 that, by way of example, may present the same characteristics as the characteristics of the filter F4 in FIG. 5. It is thus possible to guarantee that the top sealing lip 16 does not come into contact with air that contains bacteria.

FIG. 7 shows a fluid dispenser comprising a reservoir 1 associated with a dispenser member 2. The dispenser member 2 is a conventional pump that is mounted in stationary and leaktight manner on the neck 15 of the reservoir. The dispenser member 2 is provided with a pusher 3 that defines a dispenser orifice 31. Optionally, the dispenser includes a protective cap 4 that come to cover the dispenser member 2. As with the FIG. 1 dispenser, the fluid reservoir 1 comprises a slide cylinder 11 that is associated with a follower-piston 14 in such a manner as to define a working volume 10 of capacity that varies. The slide cylinder 11 is provided with a bottom 12 so as to define a confinement space E between the bottom 12 and the follower-piston 14. With reference to FIG. 8, it can be seen that the bottom 12 is received by snap-fastening in a housing 114 that is formed at the bottom end of the cylinder 11. In the invention, the bottom 12 is constituted by a rigid bacteriostatic porous material, such that it can be said that the bottom 12 constitutes a bacterial filter F6. It is not necessary to make any holes in the bottom 12. The lips 16 of the follower-piston 14 may come into contact only with air that is bacteria free.

FIG. 9 shows a seventh embodiment in which the bottom 12 is perforated with a plurality of holes 13 and includes a layer of bacteriostatic porous material on its face facing the equalizing space E. In the meaning of the invention, this layer constitutes a bacterial filter F7. The filter F7 occupies a portion of the confinement space E. By way of example, it may be deposited on, or applied to, the bottom 12 using any technique, before said bottom is mounted in the cylinder 11. In a variant, it is possible to envisage depositing the filter on the outer face of the bottom.

The characteristics implemented in the various embodiments may be associated with one another in order to create other embodiments.

However, the various embodiments shown in the figures present a common characteristic whereby the air that comes into contact with the sealing lip(s) of the follower-piston is freed from bacteria by a bacterial filter that may be secured either to the bottom or to the follower-piston.

The invention claimed is:

1. A fluid dispenser comprising a fluid reservoir, and a dispenser member that is mounted on the reservoir for taking fluid therefrom, the reservoir comprising a slide cylinder that is cylindrical, and a follower-piston that is movable by sliding inside the slide cylinder, the follower-piston including at least one lip that is in sliding contact with the cylinder, the slide cylinder including a bottom, an equalizing space being formed between the follower-piston and the bottom, this space communicating with the outside so as to keep the space at atmospheric pressure, such that, each time fluid is dispensed, outside air penetrates into the space, which increases as the follower-piston moves away from the bottom;

wherein a bacterial filter filters outside air coming into contact with the lip of the follower-piston through the equalizing space; and wherein the bacterial filter is secured to the follower-piston so as to move with the follower piston.

2. A dispenser according to claim 1, wherein the bacterial filter is arranged in the space.

3. A dispenser according to claim 1, wherein the bacterial filter fills, at least in part, the space at a start of the stroke of the follower-piston.

4. A dispenser according to claim 1, wherein the follower-piston includes a top sealing lip that is in sliding contact with the cylinder and a bottom lip that is provided with grooves, the space further extending between the two lips of the follower-piston, and the annular space situated between the slide cylinder and the lips of the follower-piston is filled, at least in part, with a bacterial filter.

5. A dispenser according to claim 1, wherein the dispenser member is a pump or a valve.

6. A dispenser according to claim 1, wherein the bottom is at an end of the slide cylinder opposite from the dispenser member.

* * * * *